US010183230B2

(12) United States Patent
Todokoro

(10) Patent No.: US 10,183,230 B2
(45) Date of Patent: Jan. 22, 2019

(54) EYEGLASSES TOY

(71) Applicant: Genie Toys plc, Cheltenham (GB)

(72) Inventor: Shinji Todokoro, Tokyo (JP)

(73) Assignee: Genie Toys plc (GB)

( * ) Notice: Subject to any disclaimer, the term of this patent is extended or adjusted under 35 U.S.C. 154(b) by 0 days.

(21) Appl. No.: 15/251,539

(22) Filed: Aug. 30, 2016

(65) Prior Publication Data

US 2017/0348606 A1 Dec. 7, 2017

(30) Foreign Application Priority Data

Jun. 3, 2016 (JP) ..... 2016-111816

(51) Int. Cl.

| | |
|---|---|
| ***A63H 33/00*** | (2006.01) |
| ***A63H 33/22*** | (2006.01) |
| ***A41G 7/02*** | (2006.01) |
| ***A63J 7/00*** | (2006.01) |
| ***A63H 3/40*** | (2006.01) |
| ***A63H 3/52*** | (2006.01) |

(52) U.S. Cl.

CPC ..... *A63H 33/22* (2013.01); *A41G 7/02* (2013.01); *A63H 3/40* (2013.01); *A63H 3/52* (2013.01); *A63H 33/00* (2013.01); *A63J 7/005* (2013.01)

(58) Field of Classification Search

CPC ..... A41G 7/02; A63H 33/22; A63H 33/30; A63H 37/00

USPC ..... 446/27, 342, 392, 393; 351/48, 58

See application file for complete search history.

(56) References Cited

U.S. PATENT DOCUMENTS

| | | | | |
|---|---|---|---|---|
| 631,227 A * | 8/1899 | Peppard | ..... | G02B 23/18 2/15 |
| 1,526,211 A * | 2/1925 | Hirschman | ..... | A63H 33/22 273/DIG. 17 |
| 2,598,107 A | 5/1952 | Brandvig | | |

(Continued)

FOREIGN PATENT DOCUMENTS

| | | |
|---|---|---|
| JP | S60-47590 U | 4/1985 |
| JP | 1993-041596 U | 6/1993 |

OTHER PUBLICATIONS

European Communication dated Nov. 2, 2017, from corresponding EP Application No. 16185983.0.

*Primary Examiner* — Melba Bumgarner
*Assistant Examiner* — Joseph B Baldori
(74) *Attorney, Agent, or Firm* — DLA Piper LLP (US)

(57) ABSTRACT

To entertain viewers more by adopting motions different from the conventional ones, there is provided an eyeglasses toy having an eyeglasses frame comprising a rim member and temple members, eyeball members fixed to the rim member and comprising spherical surface portions which project forwards from the rim member, rotational eyelid members which are provided rotatably so as to cover and expose the spherical surface portions of the eyeball members, biasing members which bias the rotational eyelid members in a direction in which the rotational eyelid members expose the spherical surface portions of the eyeball members, and operating members or strings which rotate the rotational eyelid members in a direction in which the rotational eyelid members cover the spherical surface portions of the eyeball members against biasing forces of the biasing members, wherein the strings have a chin locked portion which is locked on the chin of a wearer.

14 Claims, 7 Drawing Sheets

(56) References Cited

U.S. PATENT DOCUMENTS

| | | | | | |
|---|---|---|---|---|---|
| 2,746,204 | A * | 5/1956 | Karpf | A63H 37/00 | 273/DIG. 17 |
| 2,748,528 | A * | 6/1956 | Wolf | A41G 7/02 | 2/206 |
| 2,859,552 | A * | 11/1958 | Bornstein | A63H 3/40 | 446/27 |
| 3,081,997 | A * | 3/1963 | Glass | A63H 3/40 | 446/342 |
| 3,182,422 | A * | 5/1965 | Ryan | A63H 27/14 | 273/DIG. 17 |
| 3,435,556 | A * | 4/1969 | Clarke | A42B 1/242 | 362/106 |
| 3,757,465 | A * | 9/1973 | Barlow | A63H 3/40 | 446/341 |
| 4,900,289 | A * | 2/1990 | May | A63H 3/365 | 446/301 |
| D321,700 | S * | 11/1991 | Smith | D16/306 | |
| 5,681,040 | A * | 10/1997 | Peterson | G04B 45/0038 | 273/148 R |
| 6,789,897 | B2 * | 9/2004 | Smith | A61F 9/029 | 351/159.01 |
| 2013/0329180 | A1 * | 12/2013 | Johnson | G02C 11/02 | 351/52 |

* cited by examiner

EYEGLASSES TOY

CROSS-REFERENCE TO RELATED APPLICATION

This application is based upon and claims the benefit of priority under 35 USC 119 of Japanese Patent Application No. 2016-111816 filed on Jun. 3, 2016, the entire disclosure of which, including the specification, claims, drawings and abstract, is incorporated herein by reference.

BACKGROUND OF THE INVENTION

Field of the Invention

The present invention relates to an eyeglasses toy configured to be used in a performance for entertainment.

Description of the Related Art

There have conventionally been provided eyeglasses toys having provided thereon pictures or models of some portions of a face such as eyes and a nose. With some of these eyeglasses toys, a person who wears the eyeglasses toy can entertain those who take part in an entertainment event by moving the pictures or models featuring the portions of the face provided on the eyeglasses toy. For example, Japanese Unexamined Utility Model Publication No. 5-41596 discloses an entertainment eyeglasses toy in which eyebrows are connected to eyes and a left eye and a right eye are connected together by a gear. According to this entertainment eyeglasses toy, the eyebrows and the eyes move in an interlocked fashion, whereby a facial expression with the eyes turned up or down can be provided. Further, a string is attached to each of the eyes so that the eye and the eyebrow can be moved in an interlocked fashion.

These conventional entertainment eyeglasses toys can entertain the viewers by switching easily the facial expressions between one with the eyes turned up and the other with the eyes turned down. However, only the rotational motions of the eyebrows and the eyes which are provided on those entertainment eyeglasses toys cannot keep the viewers interested therein for a long time.

SUMMARY OF THE INVENTION

The invention has been made in view of the situations described above, and an object of the invention is to provide an eyeglasses toy which adopts movements which are different from the conventional ones for further entertainment.

According to an aspect of the invention, there is provided an eyeglasses toy having an eyeglasses frame including a rim member and temple members, eyeball members fixed to the rim member and including spherical surface portions which project forwards from the rim member, rotational eyelid members which are provided rotatably so as to cover and expose the spherical surface portions of the eyeball members, biasing members which bias the rotational eyelid members in a direction in which the rotational eyelid members expose the spherical surface portions of the eyeball members, and operating members which rotate the rotational eyelid members in a direction in which the rotational eyelid members cover the spherical surface portions of the eyeball members against biasing forces of the biasing members, wherein the operating members have a chin locked portion which is locked on the chin of a wearer.

According to the aspect of the invention, the rotational eyelid members are rotated or turned up and down repeatedly by the operating members to open and close the eyes repeatedly. Then, the opening and closing operations of the eyes can be executed by operating the operating members through opening and closing the mouth of a wearer of the eyeglasses toy. Thus, since the rotational eyelid members of the eyeglasses toy can be rotated up and down by moving the face (by opening and closing the mouth) of the wearer, viewers can be entertained more by the eyeglasses toy of the invention than by the conventional eyeglasses toy.

DETAILED DESCRIPTION OF THE PREFERRED EMBODIMENT

Figure 1:
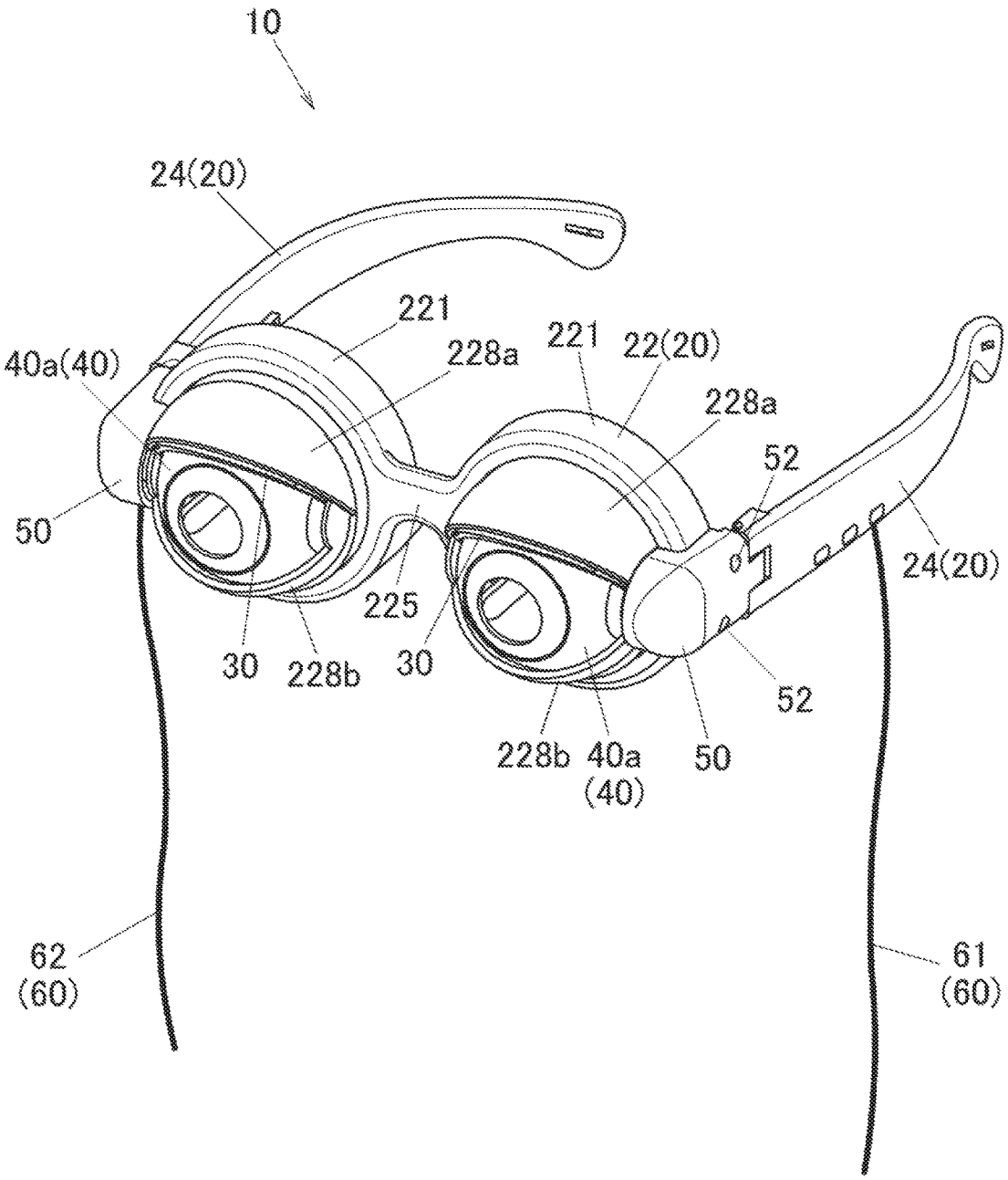
FIG. 1 is a perspective view of an eyeglasses toy according to an embodiment of the invention as viewed from a front left upper position.

Hereinafter, an embodiment of the invention will be described based on the drawings. An eyeglasses toy 10 shown in FIG. 1 is a toy reproducing a pair of eyeglasses in which a left string 61 and a right string 62, which are strings 60 functioning as operating members, are fastened together to make up a chin locked portion 65 (refer to FIGS. 6 and 7) which is wrapped around the chin of a wearer of the eyeglasses toy 10 so that rotational eyelid members 30 are rotated to entertain viewers as a result of the mouth of the wearer being opened (that is, the strings 60 being drawn). Here, when left and right are referred to in the following description, left and right denote, respectively, the left and right of the eyeglasses toy 10 when it is worn. Additionally, directions indicated by front, rear, up and down denote front, rear, up and down directions resulting when the eyeglasses toy 10 is worn.

Figure 2:
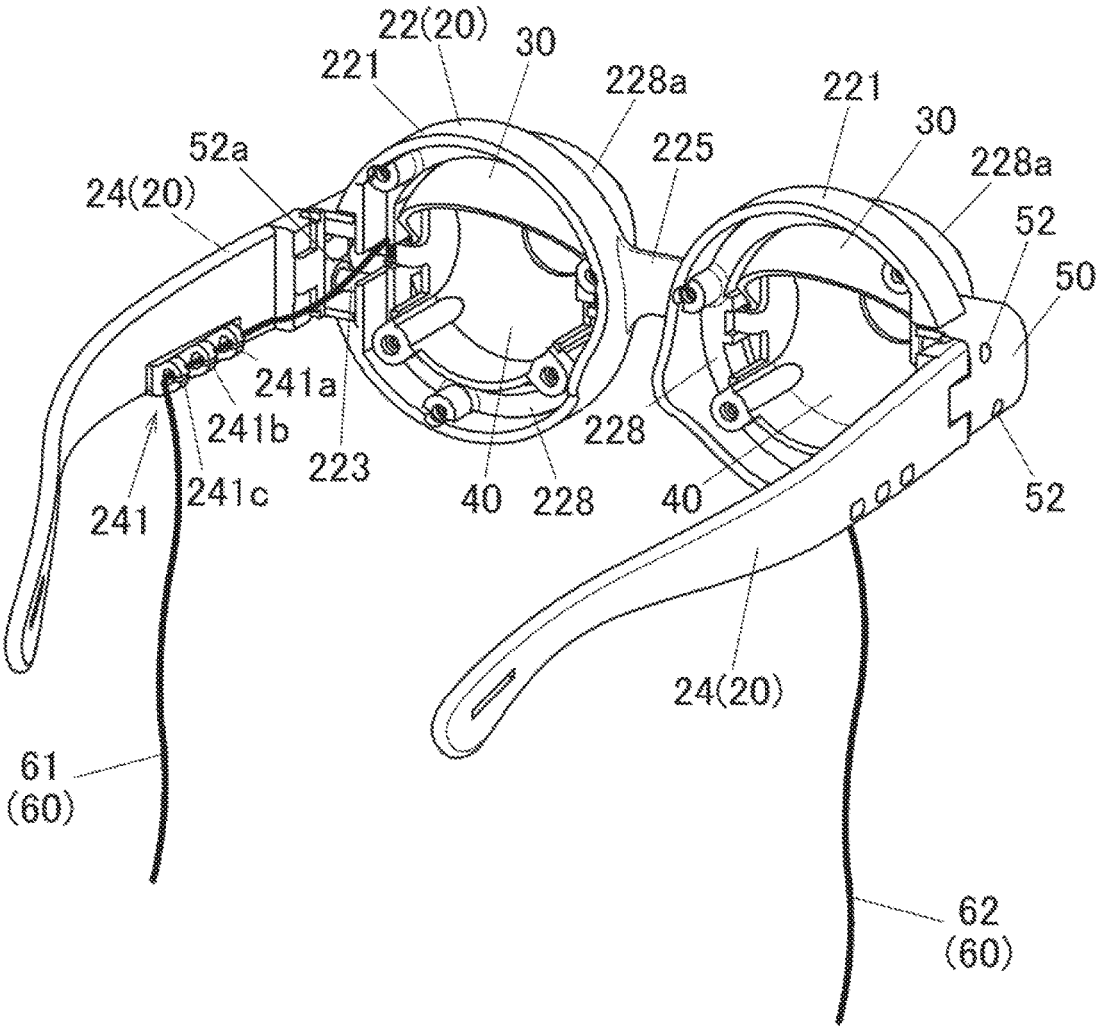
FIG. 2 is a perspective view of the eyeglasses toy according to the embodiment of the invention as viewed from a rear right upper position.
Figure 3:
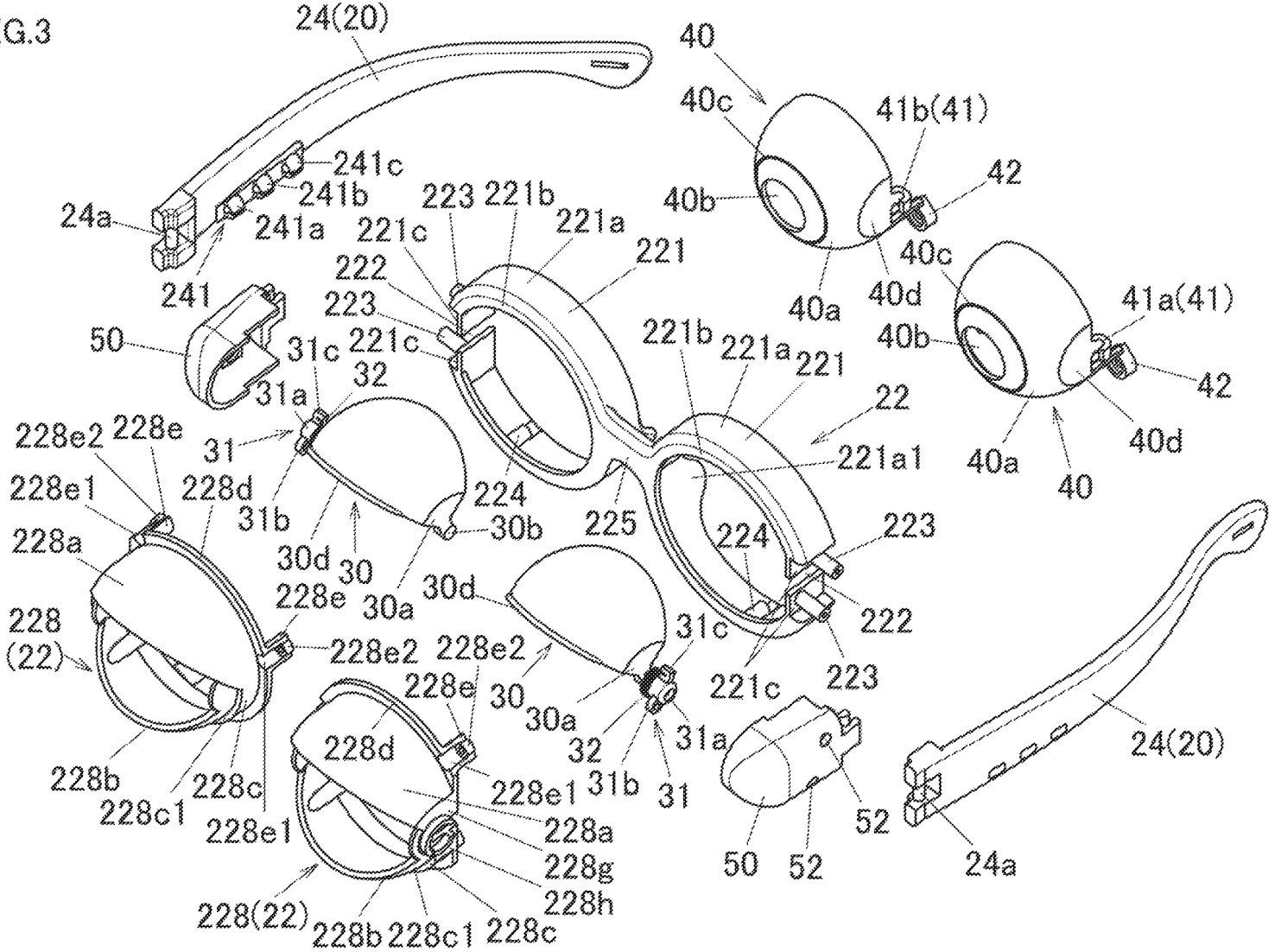
FIG. 3 is an exploded perspective view of the eyeglasses toy according to the embodiment of the invention as viewed from a front upper position.
Figure 4:
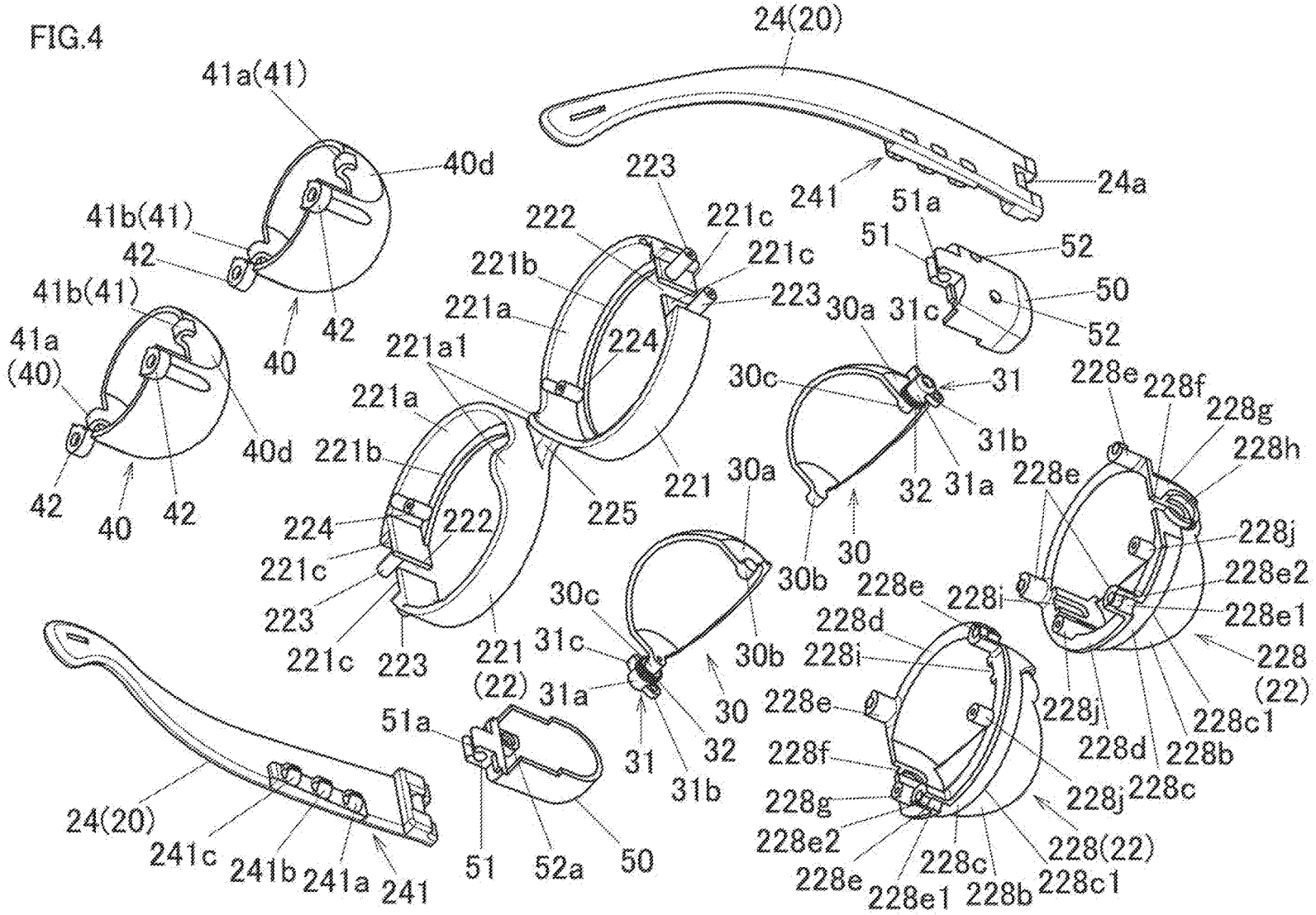
FIG. 4 is an exploded perspective view of the eyeglasses toy according to the embodiment of the invention as viewed from a rear lower position.

FIG. 1 is a perspective view of the eyeglasses toy 10 as viewed from a front left upper position. FIG. 2 is a perspective view of the eyeglasses toy 10 as viewed from a rear right upper position. FIG. 3 is an exploded perspective view of the eyeglasses toy 10 as viewed from a front upper position. FIG. 4 is an exploded perspective view of the eyeglasses toy 10 as viewed from a rear lower position.

As shown in FIGS. 1 to 4, an eyeglasses frame 20 includes a rim member 22 and two temple members 24. As shown in FIGS. 3 and 4, the rim member 22 includes frame-shaped rims 221 which are connected by a bridge portion 225 and fixed eyelid members 228. Each frame-shaped rim 221 has a slit 222 which is formed at an outer end portion. The slit 222 is formed in a front-to-rear direction. Consequently, each frame-shaped rim 221 has a substantially C-like annular external shape when seen from the front. Each frame-shaped rim 221 has a cylindrical portion 221*a* which has a C-like annular cylindrical shape and an annular projecting portion 221*b* which projects from a front end of the cylindrical portion 221*a* radially inwards into a C-like annular shape. Two step portions 221*c* are formed on an outer surface of each cylindrical portion 221*a* at locations which hold the slit 222 therebetween so that an end portion of the cylindrical portion 221*a* where the slit 222 is formed has a recessed shape. One boss 223 is provided on each step portion 221*c* so as to rise therefrom. In addition, three bosses 224 (all of which are not shown) are formed on an inner circumferential surface of each cylindrical portion 221*a* so as to be disposed at substantially equal intervals in a circumferential direction.

The cylindrical portions 221*a* of the frame-shaped rims 221 are connected together by the bridge portion 225 having a substantially plate shape in positions where they face each other (that is, in positions which lie on an opposite side to the side where the step portions 221*c* are formed). A pad portion 221*a*1 is formed on an outer circumferential surface of each cylindrical portion 221*a* in a position which lies near to and slightly lower than the bridge portion 225 so as to project to the rear.

As shown in FIG. 1, the fixed eyelid member 228 is fixed in place within a frame of each frame-shaped rim 221. Each fixed eyelid member 228 has an upper and lower spherical surface portions 228*a*, 228*b* which are formed at an upper and lower portions of the fixed eyelid member 228, respectively. The spherical surface portions 228*a*, 228*b* are formed so as to have a fan-shaped vertical section and an outer surface which is formed into a convexly curved spherical surface. In other words, the spherical surface portions 228*a*, 228*b* are formed into a shape resulting when a spherical body is cut into segments. As shown in FIG. 4 particularly, a substantially semi-circular outer circumferential arc portion 228*c* is formed on an outer circumference of a proximal end portion of the lower spherical surface portion 228*b* so as to project in a radial direction. As shown in FIG. 3 particularly, the outer surface of the upper spherical surface portion 228*a* continues to an outer surface of the outer circumferential arc portion 228*c*. Consequently, a step portion 228*c*1 is formed between the outer surface of the lower spherical surface portion 228*b* and the outer surface of the outer circumferential arc portion 228*c*.

Flange portions 228*d* are formed individually along proximal end portions of the upper spherical surface portions 228*a* and the outer circumferential arc portions 228*c*. Three boss fixing portions 228*e* are provided on a rear surface of each flange portion 228*d* so as to rise to the rear therefrom, and the three boss fixing portions 228*e* are disposed at substantially equal angular intervals in a circumferential direction when seen from the rear. A substantially semi-cylindrical boss accommodating portion 228*e*1 is formed on a front side of each boss fixing portion 228*e*. A cylindrical boss abutment portion 228*e*2 is formed on a rear side of each boss fixing portion 228*e* at a portion corresponding to a rear end portion of the boss accommodating portion 228*e*1. A diameter of the boss abutment portion 228*e*2 is made smaller than an outside diameter of the boss accommodating portion 228*e*1.

The boss fixing portions 228*e* and the bosses 224 of the frame-shaped rim 221 are disposed so as to face each other. Then, in attaching the fixed eyelid member 228 to the frame shaped rim 221, the bosses 224 are accommodated in the boss accommodating portions 228*e*1 of the boss fixing portions 228*e*, and end faces of the bosses 224 are brought into abutment with front end faces of the boss abutment portions 228*e*2. As this occurs, a front surface of the flange portion 228*d* is brought into abutment with a rear surface of the annular projecting portion 221*b* of the frame shaped rim 221. Then, for example, wood screws, not shown, are screwed into holes in the boss fixing portions 228*e* from the rear of the boss abutment portions 228*e*2 of the fix fixing portions 228*e*, whereby the fixed eyelid member 228 can be fixed to the frame shaped rim 221. As shown in FIG. 1, when the fixed eyelid member 228*e* is fixed to the frame shaped rim 221, the spherical surface portion 228*a* projects to the front from an upper portion of the frame shaped rim 221, and the spherical surface portion 228*b* projects to the front from a lower portion of the frame shaped rim 221.

In addition, as shown in FIG. 4, two cylindrical bosses 228*j* are formed on the rear surface of the flange portion 228*d* of each fixed eyelid member 228 so as to extend to the rear. A shaft support portion 228*f* is formed at an outer end of each fixed eyelid member 228 by cutting out the outer end of the fixed eyelid member 228 from the flange portion 228*d* to the front into a U-like shape as seen from the side. The outer end of the fixed eyelid member 228 is formed into a flat surface 228*g*, and a spring accommodating and locking portion 228*h* is formed on the flat surface 228*g* around the shaft support portion 228*f* so as to rise into a substantially C-like annular shape. A substantially C-shaped annular cut-out portion of the spring accommodating and locking portion 228*h* matches the shaft support portion 228*f*. Further, a shaft support portion 228*i* having a U-like groove shape whose longitudinal direction follows the front-to-rear direction is formed on an inner surface of the fixed eyelid member 228 which faces the shaft support portion 228*f*.

In addition, as shown in FIG. 1, an eyeball member 40 is disposed in each of the frame shaped rims 221 of the rim member 22. Then, the rotational eyelid member 30 is provided rotatably so as to cover and expose a spherical surface portion 40*a* of each of the eyeball members 40.

As shown in FIGS. 3 and 4, each of the rotational eyelid members 30 is formed so as to have a fan-shaped vertical section and an outer surface which is formed into a convexly curved spherical surface. In other words, the rotational eyelid members 30 are formed into a shape resulting when a hollow spherical body is cut into segments. An arc-shaped projection 30*d* is formed at a front edge of each of the rotational eyelid members 30 so as to project therefrom into an arc-like shape. A flat surface 30*a* is formed at each end of each of the rotational eyelid members 30. Cylindrical rotational shafts 30*b* are formed on the facing flat surfaces 30*a* of each of the rotational eyelid members 30 so as to project into a cylindrical shape. A cylindrical rotational shaft 30*c* is formed on each of the flat surfaces 30*a* which face in opposite directions (that is, on the outer flat surfaces 30*a*).

A rotation transmission portion 31 is formed at an end portion of each of the rotational shafts 30*c*. The rotation transmission portion 31 has a string locking portion 31*b* which projects from an outer circumference of a cylindrical main body tube 31*a* and a spring locking portion 31*c* which projects radially outwards from the outer circumference of the main body tube 31*a* into a plate shape. A torsional coil spring 32, which is a biasing member, is provided on the outer circumference of each of the main body tubes 31*a* between the spring locking portion 31*c* and the flat surface 30*a*. One of legs of each of the torsional coil springs 32 is brought into abutment with the spring locking portion 31*c* and is then locked thereon.

The rotational shafts 30*b* of the rotational eyelid members 30 are supported rotatably in the shaft support portions 228*i* which are provided on the inner surfaces of the ends of the fixed eyelid members 228 which face each other. On the other hand, the rotational shafts 30*c* of the rotational eyelid members 30 are supported rotatably in the shaft supports portions 228*f* which lie at the respective outer ends of the fixed eyelid members 228. Then, the torsional coil springs 32 are accommodated in the spring accommodating and locking portions 228*h*, and the other legs of the torsional coil springs 32 are locked individually in the spring accommodating and locking portions 228*h*. On the other hand, as has been described above, the one leg of each of the torsional coil springs 32 is brought into abutment with the spring locking portion 31*c* so as to be locked therein. Consequently, the rotational eyelid members 30 are biased by the torsional coil springs 32 in a direction in which the arc-shaped projections 30*d* are brought into abutment with edges of the upper spherical surface portions 228*a* (that is, in a direction in which the spherical surface portions 40*a* of the eyeball members 40 are exposed).

As shown in FIG. 1, the eyeball members 40 are fixed in place in the rim member 22 (specifically speaking, the fixed eyelid members 228) so that the spherical surface portions 40*a* project to the front from the rim member 22. Then, the eyeball members 40 are disposed underneath the rotational eyelid members 30. In other words, the rotational eyelid members 30 are disposed so as to rotate between the eyeball members 40 and the fixed eyelid members 228. As shown in FIGS. 3, 4, the eyeball members 40 have a semi-spherical shape. An opening portion 40*b* is formed in a center or an apex portion of each of the eyeball members 40 so as to ensure the field of vision of the wearer when he or she wears the eyeglasses toy 10. A concentric annular step portion 40*c* is formed on an outer circumference of the opening portion 40*b*, which serves to represent an eyeball pattern more prominently.

Flat surfaces 40*d* are formed at both ends of each of the eyeball members 40. A guided portion 41 is formed on each of the flat surfaces 40 in such a way as to be folded back to the front into a hook-like shape. An outer guided portion 41*a* is inserted into the corresponding shaft support portion 228*f* of the fixed eyelid member 228. An opposite guided portion 41*b*, which lies opposite to the guided portion 41*a* (that is, an inner guided portion) is inserted into the corresponding shaft support portion 228*i* of the fixed eyelid member 228. By doing so, the shaft portions 30*b*, 30*c* which are supported by the shaft support portions 228*f*, 228*i* are prevented from being dislocated therefrom.

Two fixing portions 42 are formed individually at end edges of each of the eyeball members 40 so as to project outwards. The fixing portions 42 are disposed so as to match the two bosses 228*j* of each of the fixed eyelid members 228. Front surfaces of the fixing portions 42 are brought into abutment with end faces of the bosses 228*j*. Consequently, the eyeball members 40 are fixed to the fixed eyelid members 228 by screwing wood screws, not shown, from the rear of the fixing portions 42.

The temple members 24 are connected to the rim member 22 via corresponding hinge members 50. More specifically, the hinge members 50 are each formed substantially into a shell shape, and a shaft support portion 51 is formed at a rear end of each of the hinge members 50. The shaft support portion 51 has a fitting portion 51*a* which is formed so as to hold rotatably a cylindrical shaft which is fitted therein. On the other hand, shaft portions 24*a* are formed individually at front ends of the temple members 24 which are formed long. The shaft portions 24*a* are held rotatably by the shaft support portions 51 via the fitting portions 51*a*. By doing so, the temple members 24 are made to be folded up freely relative to the rim member 22.

Two fixing portions 52 are formed on each of the hinge members 50, and a boss abutment portion 52*a* is provided in an interior of each of the fixing portions 52. The bosses 223 of the frame shaped rim 221 are brought into abutment with the boss abutment portions 52*a*, so that the hinge member 50 is fixed to the frame shaped rim 221 with wood screws, not shown. As this occurs, the rotation transmission portion 31 and the torsional coil spring 32 are accommodated in an interior of the hinge member 50.

A guide portion 241 is formed on an inner side of each of the temple ember 24 at a front and slightly lower portion thereof. The guide portion 241 is formed of three guides 241*a*, 241*b*, 241*c* each having a substantially C-shaped annular section. The guides 241*a*, 241*b*, 241*c* are disposed so as to be aligned along a longitudinal direction of the temple member 24. The string 60 is passed through the guides 241*a*, 241*b*, 241*c*. The string 60 is passed through anyone of the guides 241*a*, 241*b*, 241*c* to change a distance from the chin of the wearer of the eyeglasses toy 10 which functions as an operating point to the string locking portion 31*b* where the string 60 is locked, whereby a stroke of the string 60 which rotates the rotational eyelid member 30 can be controlled. For example, when a child whose face is relatively small wears the eyeglasses toy 10, the child can enjoy playing with the eyeglasses toy 10 by passing the string 60 only through the guide 241*a* at the front end. On the contrary, when an adult whose face is relatively large wears the eyeglasses toy 10, by passing the string 60 through all of the three guides 241*a*, 241*b*, 241*c*, the rotational eyelid member 30 can be rotated smoothly.

Figure 5A:
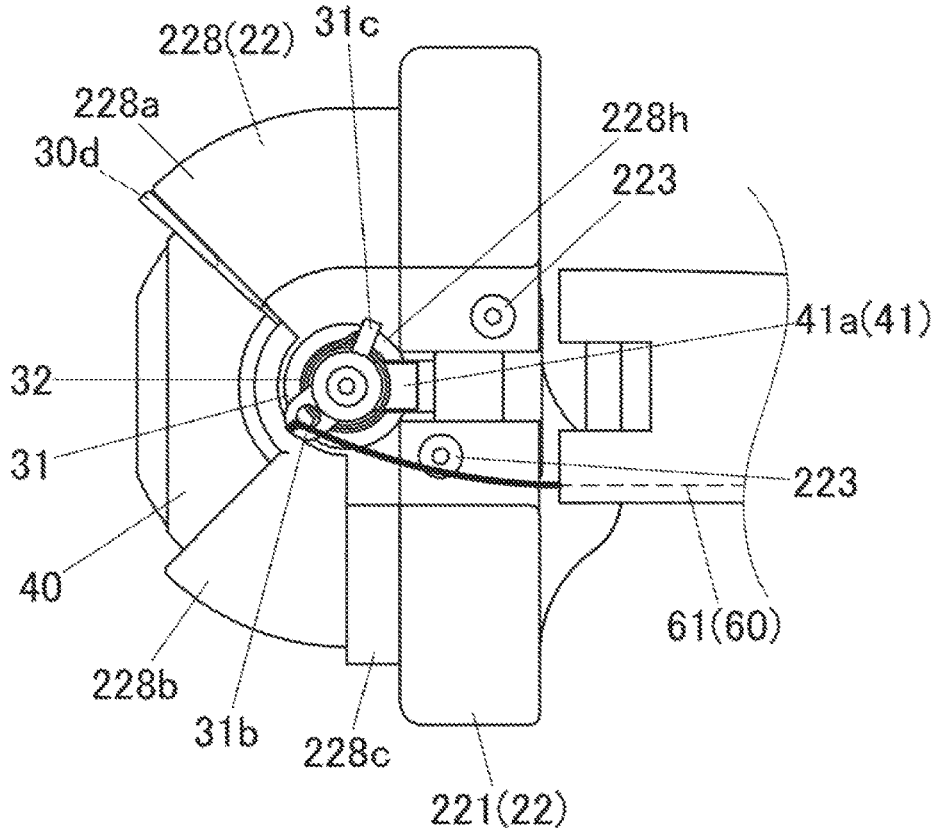
FIG. 5A is a side view of the eyeglasses toy according to the embodiment of the invention with a hinge member removed therefrom, showing a rotating operation of a rotational eyelid member performed to expose an eyeball member.
Figure 5B:
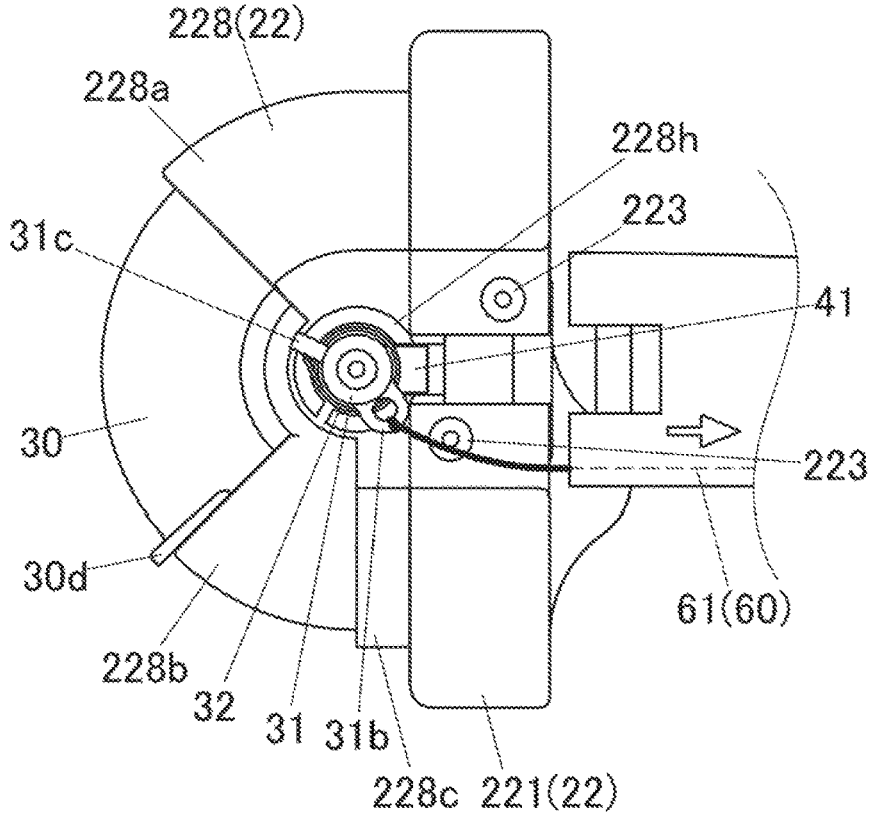
FIG. 5B is a side view of the eyeglasses toy according to the embodiment of the invention with the hinge member removed therefrom, showing a rotating operation of the rotational eyelid member performed to cover the eyeball member.
Figure 6:
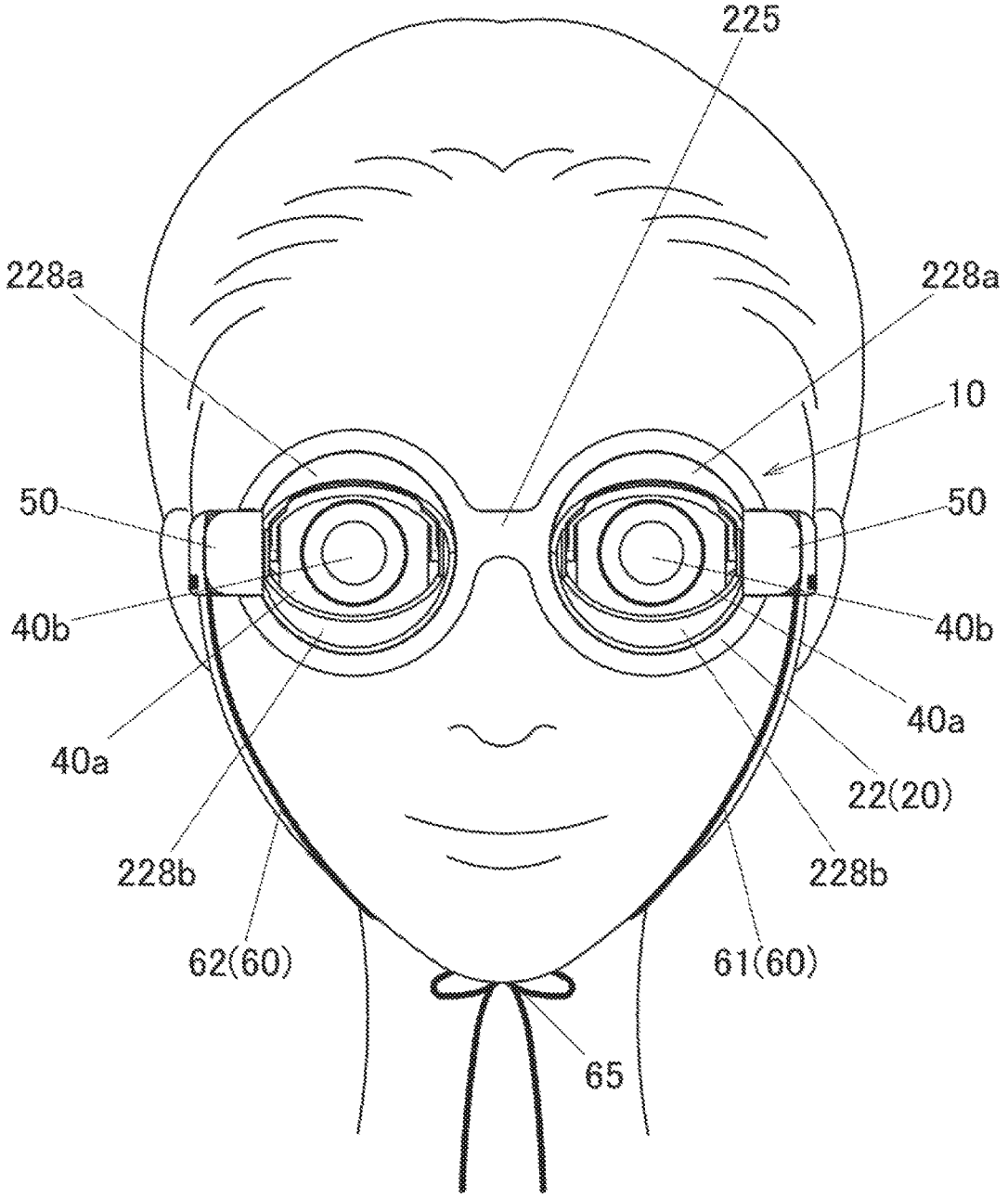
FIG. 6 is a front view of the eyeglasses toy according to the embodiment of the invention, showing a state in which the eyeglasses toy is operated to expose the eyeball members.

The rotational eyelid member 30 rotates on the rotational shafts 30*b*, 30*c*. Here, FIG. 5A shows a state in which the spherical surface portion 40*a* of the eyeball member 40 is exposed, and FIG. 5B shows a state in which the spherical surface portion 40*a* of the eyeball member 40 is covered by the rotational eyelid member 30. In FIGS. 5A, 5B, the hinge member 50 is omitted from illustration. Then, the eyeglasses toy 10 is worn as shown in FIG. 6. In this embodiment, the left string 61 and the right string 62 are fastened together into the chin locked portion 65. However, a detachable fastening member may be used to join the left string 61 and the right string 62 together.

Figure 7:
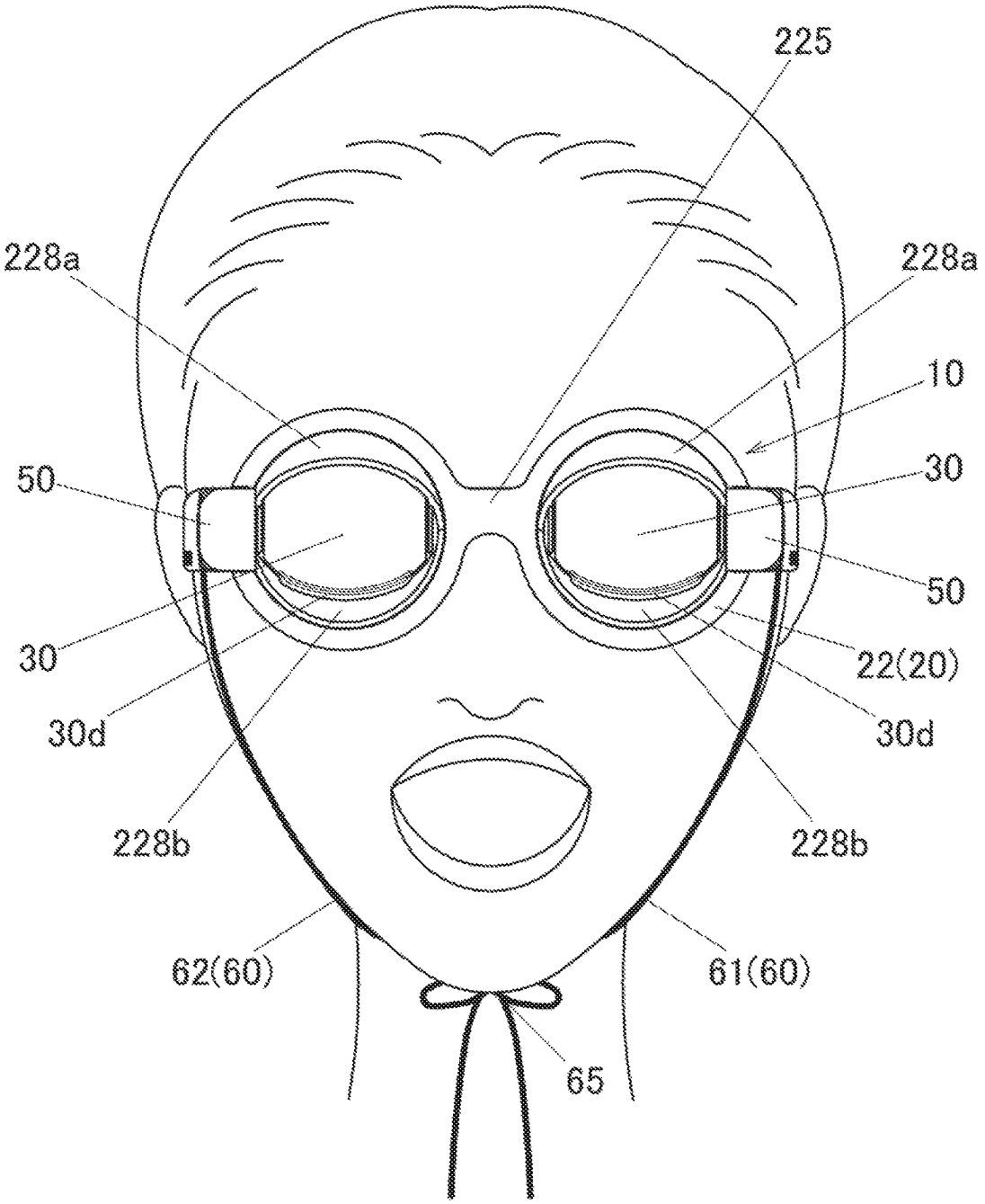
FIG. 7 is a front view of the eyeglasses toy according to the embodiment of the invention, showing a state in which the eyeglasses toy is operated to cover the eyeball members.

Then, as shown in FIG. 7, when the wearer opens his or her mouth, the strings 60 are moved downwards by an amount equal to an amount by which a lower end of the chin is moved downwards. Then, as indicated by an arrow in FIG. 5B, the string 60 is pulled to the rear. As this occurs, the rotation transmission portion 31 rotates against the biasing force of the torsional coil spring 32. Then, the rotational eyelid member 30 rotates so as to cover the spherical surface portion 40*a* of the eyeball member 40. The rotation of the rotational eyelid member 30 is restricted as a result of the arc-shaped projection 30*d* being brought into abutment with the edge of the lower spherical surface portion 228*b*. Then, since the rotational eyelid member 30 is biased by the torsional coil spring 32 in the direction in which the rotational eyelid member 30 exposes the spherical surface portion 40*a* of the eyeball member 40, when the wearer closes his or her mouth as shown in FIG. 6, the eyeglasses toy 10 is returned to the state shown in FIG. 5A. As this occurs, the rotation of the rotational eyelid member 30 is restricted as a result of the arc-shaped projection 30*d* being brought into abutment with the edge of the upper spherical surface portion 228*a*.

In this way, according to the eyeglasses toy 10, the rotational eyelid members 30 can be rotated as the wearer opens his or her mouth, and therefore, the eyeglasses toy 10 can be operated in such a way that the eyes are opened and closed quickly and repeatedly as the mouth is opened and closed. Consequently, the change in appearance of the eyeglasses toy 10 is synchronized with the change in facial expression of the wearer of the eyeglasses toy 10, whereby the wearer can enjoy entertaining viewers.

In the eyeglasses toy 10, the fixed eyelid members 228 each including the spherical surface portions 228*a*, 228*b* are formed, and the rotational eyelid members 30 rotate between the fixed eyelid members 228 of the eyeball members 40. By adopting this configuration, the eyeglasses toy 10 can produce a more comical facial expression. Then, the torsional coil springs 32 and the rotational transmission portions 31 where the torsional coil springs 32 are locked are accommodated in the interiors of the hinge members 50 which are positioned on the sides of the eyes. By adopting this configuration, the torsional coil springs 32 and the rotation transmission portions 31 can be covered with the hinge members 50.

Thus, while the embodiment of the invention has been described heretofore, the invention is not limited by the embodiment and hence can be modified variously. For example, in this embodiment, while the strings 60 are fastened together at the chin to function as the operating members, the invention is not limited thereto. Thus, if they can be worn on the chin of the wearer of the eyeglasses toy 10, molded parts can be used to connect the strings 60.

What is claimed is:

1. An eyeglasses toy comprising:

an eyeglasses frame comprising a rim member and temple members the eyeglasses frame adapted to be worn by a user;

eyeball members fixed to the rim member and comprising semi-spherical surface portions that project forward from the rim member;

rotational eyelid members provided rotatably to cover and expose the semi-spherical surface portions of the eyeball members;

biasing members that bias the rotational eyelid members in a direction in which the rotational eyelid members expose the semi-spherical surface portions of the eyeball members; and operating members that rotate the rotational eyelid members in a direction in which the rotational eyelid members cover the semi-spherical surface portions of the eyeball members against biasing forces of the biasing members, wherein the operating members are adapted to be fastened around a chin of the user to create a chin locked portion and the rotational eyelid members are moveable toward the direction in which the rotational eyelid members cover the semi-spherical surface portions of the eyeball members in proportion to a pulling force applied to the chin locked portion and the rotational eyelid members are moveable toward the direction in which the rotational eyelid members expose the semi-spherical surface portions of the eyeball members by release of the force applied to the chin locked portion.

2. The eyeglasses toy according to claim 1, wherein the rim member has frame shaped rims connected together by a bridge portion and fixed eyelid members having upper and lower convexly curved surface portions projecting from an upper portion and a lower portion of frames of the frame shaped rims, and wherein the rotational eyelid members rotate between the eyeball members and the fixed eyelid members.

3. The eyeglasses toy according to claim 2, wherein the eyeball members each comprise an opening portion at an apex portion of the semi-spherical surface portion.

4. The eyeglasses toy according to claim 2, wherein the eyeball members each comprise an opening portion at an apex portion of the semi-spherical surface portion, the operating members are strings, and a plurality of guide portions are formed on an inner side of each of the temple members along a longitudinal direction of the temple member to guide the string.

5. The eyeglasses toy according to claim 1, wherein the eyeball members each comprise an opening portion at an apex portion of the semi-spherical surface portion.

6. The eyeglasses toy according to claim 1, wherein the rim member has frame shaped rims connected together by a bridge portion and fixed eyelid members having upper and lower convexly curved surface portions projecting from an upper portion and a lower portion of frames of the frame shaped rims, the rotational eyelid members rotate between the eyeball members and the fixed eyelid members, and the rim member comprises hinge members that connect the temple members and the rim member together so that the temple members can be folded relative to the rim member, and the biasing members are disposed in interiors of the hinge members.

7. The eyeglasses toy according to claim 1, wherein the eyeball members each comprise an opening portion at an apex portion of the semi-spherical surface portion, and the rim member comprises hinge members that connect the temple members and the rim member together so that the temple members can be folded relative to the rim member, and the biasing members are disposed in interiors of the hinge members.

8. The eyeglasses toy according to claim 1, wherein the rim member has frame shaped rims connected together by a bridge portion and fixed eyelid members having upper and lower convexly curved surface portions projecting from an upper portion and a lower portion of frames of the frame shaped rims, the rotational eyelid members rotate between the eyeball members and the fixed eyelid members, the eyeball members each comprise an opening portion at an apex portion of the semi-spherical surface portion, and the rim member comprises hinge members that connect the temple members and the rim member together so that the temple members can be folded relative to the rim member, and the biasing members are disposed in interiors of the hinge members.

9. The eyeglasses toy according to claim 1, wherein the operating members are strings, and a plurality of guide portions are formed on an inner side of each of the temple members along a longitudinal direction of the temple member to guide the string.

10. The eyeglasses toy according to claim 1, wherein the rim member has frame shaped rims connected together by a bridge portion and fixed eyelid members having upper and lower convexly curved surface portions projecting from an upper portion and a lower portion of frames of the frame shaped rims, the rotational eyelid members rotate between the eyeball members and the fixed eyelid members, the operating members are strings, and a plurality of guide portions are formed on an inner side of each of the temple members along a longitudinal direction of the temple member to guide the string.

11. The eyeglasses toy according to claim 1, wherein the eyeball members each comprise an opening portion at an apex portion of the semi-spherical surface portion, the operating members are strings, and a plurality of guide portions are formed on an inner side of each of the temple members along a longitudinal direction of the temple member to guide the string.

12. The eyeglasses toy according to claim 1, wherein the rim member has frame shaped rims connected together by a bridge portion and fixed eyelid members having upper and lower convexly curved surface portions projecting from an upper portion and a lower portion of frames of the frame shaped rims, the rotational eyelid members rotate between the eyeball members and the fixed eyelid members, the rim member comprises hinge members that connect the temple members and the rim member together so that the temple members can be folded relative to the rim member, and the biasing members are disposed in interiors of the hinge members, the operating members are strings, and a plurality of guide portions are formed on an inner side of each of the temple members along a longitudinal direction of the temple member to guide the string.

13. The eyeglasses toy according to claim 1, wherein the eyeball members each comprise an opening portion at apex portion of the semi-spherical surface portion, the rim member comprises hinge members that connect the temple members and the rim member together so that the temple members can be folded relative to the rim member, and the biasing members are disposed in interiors of the hinge members, the operating members are strings, and a plurality of guide portions are formed on an inner side of each of the temple members along a longitudinal direction of the temple member to guide the string.

14. The eyeglasses toy according to claim 1, wherein the rim member has frame shaped rims connected together by a bridge portion and fixed eyelid members having upper and lower convexly curved surface portions projecting from an upper portion and a lower portion of frames of the frame shaped rims, the rotational eyelid members rotate between the eyeball members and the fixed eyelid members, the eyeball members each comprise an opening portion at an apex portion of the semi-spherical surface portion, the rim member comprises hinge members that connect the temple members and the rim member together so that the temple members can be folded relative to the rim member, and the biasing members are disposed in interiors of the hinge members, the operating members are strings, and a plurality of guide portions are formed on an inner side of each of the temple members along a longitudinal direction of the temple member to guide the string.

* * * * *